US010527053B2

(12) United States Patent
Xu et al.

(10) Patent No.: US 10,527,053 B2
(45) Date of Patent: Jan. 7, 2020

(54) OPEN WATER PUMP

(71) Applicant: NINGBO FOTILE KITCHEN WARE CO., LTD, Ningbo (CN)

(72) Inventors: Hui Xu, Cixi (CN); Yangzhong Lian, Cixi (CN); Dengguang Zhu, Cixi (CN); Feng Zheng, Cixi (CN); Shuai Li, Cixi (CN); Zhongqun Mao, Cixi (CN); Yongding Zhu, Cixi (CN)

(73) Assignee: Ningbo Fotile Kitchen Ware Co., Ltd., Cixi (CN)

( * ) Notice: Subject to any disclaimer, the term of this patent is extended or adjusted under 35 U.S.C. 154(b) by 400 days.

(21) Appl. No.: 15/104,889

(22) PCT Filed: Dec. 23, 2014

(86) PCT No.: PCT/CN2014/001160
§ 371 (c)(1),
(2) Date: Jun. 15, 2016

(87) PCT Pub. No.: WO2015/100703
PCT Pub. Date: Jul. 9, 2015

(65) Prior Publication Data

US 2016/0312790 A1 Oct. 27, 2016

(30) Foreign Application Priority Data

Dec. 31, 2013 (CN) ..... 2013 1 0750285

(51) Int. Cl.
*F04D 29/24* (2006.01)
*F04D 7/02* (2006.01)
*F04D 29/42* (2006.01)

(52) U.S. Cl.
CPC ..... *F04D 29/242* (2013.01); *F04D 7/02* (2013.01); *F04D 29/4293* (2013.01)

(58) Field of Classification Search
CPC .. F04D 29/242; F04D 29/2277; F04D 29/245; F04D 29/4293; F04D 7/02;
(Continued)

(56) References Cited

U.S. PATENT DOCUMENTS 3,425,355 A * 2/1969 MacFarland ..... A47L 15/4225 134/186
3,644,056 A * 2/1972 Wiselius ..... F04D 29/2277 415/143

(Continued)

*Primary Examiner* — Justin D Seabe
*Assistant Examiner* — Joshua R Beebe
(74) *Attorney, Agent, or Firm* — Wang Law Firm, Inc.

(57) ABSTRACT

An open water pump comprises an upper casing, a lower casing, an impeller having a central shaft and a plurality of blades. Each blade has an upper portion and a lower portion. The upper casing has an upper chamber, the lower casing has a lower chamber. A plurality of inlets attached below and to a side of the lower casing, and a plurality of outlets attached to a side of the upper casing. At least the bottom portion of the lower portion of each blade which attached to the shaft gradually bends along a rotation direction of the impeller, and a ratio of a height of the lower portion of each blade to a height of the upper portion is between 1 and 5. The impeller can be allowed to draw water at a low water level, foam formed by washing liquid or food debris on the surface of water can be less likely to get into the impeller to influence the drawing of water, a sufficient amount of water can be drawn from the water inlets.

11 Claims, 4 Drawing Sheets

(58) Field of Classification Search
CPC ... F04D 1/06; F04D 1/025; F04D 1/04; F04D 1/063; F04D 1/12; F04D 1/14; F04D 9/02; F04D 29/24; A47L 15/06; A47L 15/08; A47L 15/4225
See application file for complete search history.

(56) References Cited

U.S. PATENT DOCUMENTS 4,093,401 A * 6/1978 Gravelle ..... F04D 29/284 415/143
4,418,868 A * 12/1983 Gurubatham ..... A47L 15/23 134/179
5,106,263 A * 4/1992 Irie ..... F04D 29/2255 415/106
5,253,986 A * 10/1993 Bond ..... F04D 29/0413 415/106
5,470,142 A * 11/1995 Sargeant ..... A47L 15/0084 312/258
5,651,380 A * 7/1997 Sargeant ..... A47L 15/0084 134/105
5,651,382 A * 7/1997 Sargeant ..... A47L 15/0084 134/174
5,709,237 A * 1/1998 Sargeant ..... A47L 15/0084 134/174
5,743,281 A * 4/1998 Sargeant ..... A47L 15/0084 134/176
5,755,244 A * 5/1998 Sargeant ..... A47L 15/0084 134/178

* cited by examiner

OPEN WATER PUMP

RELATE APPLICATIONS

This application is a national phase entrance of and claims benefit to PCT Application for an open water pump, PCT/CN2014/001160, filed on Dec. 23, 2014, which claims benefit to Chinese Patent Applications 201310750285.6, filed on Dec. 31, 2013. The specifications of both applications are incorporated here by this reference.

FIELD OF THE INVENTION

The present invention relates to a water pump, and in particular to an open water pump.

DESCRIPTION OF THE PRIOR ART

Before the operation of a water pump, both the water pump and a water inlet pipe must be filled with water, and then by an impeller rotating at a high speed, the liquid is energized due to inertial centrifugal force. In this way, the internal pressure of the liquid can be increased. When the impeller is rotating rapidly, water is driven to rotate by the blades and flies off the impeller due to the centrifugal force. After water inside the water pump is thrown out, a vacuum area is formed in the center portion of the impeller. Then, water from a water source enters the water inlet pipe under the atmospheric pressure (or water pressure). By such a circulation, continuous drawing of water can be realized. Due to their advantages of simple structure, easy operation, easy flow regulation, and applicability to delivery of various materials of special properties, water pumps have been widely applied in various fields, from various industrial sites to various household electrical appliances such as cloth washers, dish washers and air conditioners.

A conventional water pump, for example a discharge pump disclosed in a Chinese Patent CN1133961A (Application No.: 95107436.9), has a suction port at an axial lower end of an impeller and a discharge port on a side of the upper part thereof, and the impeller is in an enclosed pump chamber. The impeller as described above is in an enclosed space. In this way, a vacuum area may be formed in the center portion of the impeller, and then water from a water source may enter the impeller under the atmospheric pressure (or water pressure). Furthermore, since the suction port is in a same direction as the shaft of the impeller and the discharge port is perpendicular to the shaft of the impeller, and since water flowing through the impeller, when the impeller is rotating, certainly has a velocity in a same direction as the shaft of the impeller, in order to ensure that water can smoothly get out from the discharge port perpendicular to the shaft of the impeller, the impeller must be in an enclosed pump chamber, particularly the components above the pump chamber must be fixedly sealed, or otherwise water will be sprayed upward from above the pump chamber, i.e., a direction parallel to the shaft of the impeller, or the components above the pump chamber may be ejected by water.

For such a conventional water pump as described above, the impeller must be in an enclosed chamber. The structure is complicated, and the machining requirements are high. Generally, the chamber must be enclosed, or otherwise leakage of water will occur above the chamber, i.e., a direction parallel to the shaft direction of the impeller, unless the outlets are arranged in parallel to the shaft direction of the impeller.

Accordingly, an open water pump has been disclosed, for example, a dish washer disclosed in EP0807396A2. This dish washer includes: a washing chamber for accommodating dishes, a spray arm supported on the bottom of the washing chamber, and a pump which pressurizes the spray arm with washing liquid; the pump includes an impeller; the spray arm has internal surfaces which define a casing for the impeller and which define a volute which allows delivery of washing liquid from the casing to the nozzles of the spray arm; the impeller includes blades bent forwardly at their lower edges, and there are axial flow type blade sections on the bottom of the blades; after the motor has started under no load, the axial flow type blade sections lift the liquid and the pump will operate normally. However, with regard to such an impeller, the bent lower portion of the blades is short, the blades need to draw water at a high water level when rotating, and the pathway for discharging water is short, and it is likely to get foam formed by washing liquid or food debris on the surface of water into the impeller to influence the normal drawing of water; and furthermore, a small amount of water may be drawn, the flow rate is low, and the normal spraying of the rotary spray arm is influenced.

SUMMARY OF THE INVENTION

A technical problem to be solved by the present invention is, in view of the prior art, to provide an open water pump with excellent water drawing performance.

To solve the technical problem, the open water pump comprises, an upper casing; a lower casing attached to the upper casing forming a chamber; an impeller disposed inside the chamber, the impeller having a central shaft with a middle and a top; a plurality of blades distributed uniformly on a periphery surface of the shaft, each blade extends from the top of the shaft toward the middle of the shaft, each blade has an upper portion and a lower portion; a plurality of inlets attached below and to a side of the lower casing; and a plurality of outlets attached to a side of the upper casing; wherein, the upper casing has an upper chamber for accommodating the upper portion of each blade, the lower casing has a lower chamber for accommodating the lower portion of each blade, the lower portion of each blade has a bottom portion, at least the bottom portion of the lower portion of each blade which attached to the shaft gradually bends along a rotation direction of the impeller with the bottom of each blade toward the rotation direction of the impeller, and a ratio of a height of the lower portion of each blade to a height of the upper portion is between 1 and 5.

Preferably, the ratio of the height of the lower portion of the blade to the height of the upper portion is 3.

Preferably, a ratio of a radial dimension of the upper portion of the blade to a radial dimension of the lower portion is between 1 and 5, in order to ensure that a pathway of water is gradually widened when the water flow runs upward from the bottom of the impeller to reduce the flow rate.

Preferably, the ratio of the radial dimension of the upper portion to a radial dimension of the lower portion is 4/3.

Preferably, a space between the side of the lower portion of the blade and the lower casing is smaller than a space between the side of the upper portion and the upper casing, in order to ensure that the upper chamber slows down the water flow, when the water flow runs from bottom up, so that the velocity of the water flow running upward in the axial direction when arriving at the top of the impeller is reduced in order to avoid ejecting the upper casing covered on the impeller.

Preferably, in one embodiment of the present invention, the upper portion of each blade is perpendicular to the periphery surface of the shaft, the lower portion of each blade which attached to the shaft gradually bends along the rotation direction of the impeller, and a bent portion of the lower portion is distorted toward the rotation direction.

Preferably, in another embodiment of the present invention, the upper portion of each blade is perpendicular to the periphery surface of the shaft, the lower portion of each blade which attached to the shaft gradually bends in a curved shape along the rotation direction of the impeller.

Preferably, in another embodiment of the present invention, the lower portion of each blade is inclined upward from the periphery surface of the shaft away from the shaft.

Preferably, the shaft has an annular curved surface extending outward from the top of the periphery surface. In order to reduce the flow rate when the water flow moves toward the top from the bottom along with the rotation of the impeller, and to change the flowing direction of the water flow to the transverse direction from the vertical direction at the top of the shaft, therefore the annular curved surface guides the water flow, so that the water flow can also change the flowing direction without sealing the impeller.

Preferably, each blade has an arc-shaped top surface with a same radius as the annular curved surface, in order to fit with the annular curved surface at the top of the shaft and better guide the water flow.

In order to enable the top of the shaft to exert a downward suction force onto the upper casing to snap the upper casing so that no additional connection member is required between the upper casing and the lower casing, preferably, the shaft is hollow, the upper casing has a recess with a same curvature as the annular curved surface of the shaft and disposed at a position corresponding to the top of the shaft, so that a vacuum area is formed between the top of the shaft and the recess of the upper casing when the impeller is rotating.

Preferably, the bottom of the lower portion of each blade extends out of the lower casing from the lower chamber.

Compared with the prior art, the present invention has the following advantages:

in the present invention, the ratio of a height of the lower portion of each blade to a height of the upper portion is in a suitable range, the impeller can be allowed to draw water at a low water level, foam formed by washing liquid or food debris on the surface of water can be less likely to get into the impeller to influence the drawing of water, a sufficient amount of water can be drawn from the water inlets;

the radial dimension of the upper portion of the blade is larger than the radial dimension of the lower portion, the pathway of water can be gradually widened when the water flow runs upward, and thus the velocity of the water flow running upward in the axial direction can be reduced;

the shaft has an annular curved surface extending outward from the top of the periphery surface, the velocity of the water flow running upward in the axial direction can be reduced here, and water flow can be changed to the transverse direction from the longitudinal direction without sealing;

the space between the side of the lower portion of the blade and the lower casing is smaller than a space between the side of the upper portion and the upper casing, the upper chamber can slow down the water flow when the water flow runs from bottom up, the velocity of the water flow running upward in the axial direction when arriving at the top of the impeller can be reduced in order to avoid ejecting the upper casing covered on the impeller.

the vacuum area is formed between the top of the shaft and the recess of the upper casing when the impeller is rotating, the top of the shaft can exert a downward suction force onto the upper casing to snap the upper casing so that no additional connection member is required between the upper casing and the lower casing.

DETAILED DESCRIPTION OF THE PREFERRED EMBODIMENT

To enable a further understanding of the present invention content of the invention herein, refer to the detailed description of the invention and the accompanying drawings below:

Embodiment 1

Figure 1:
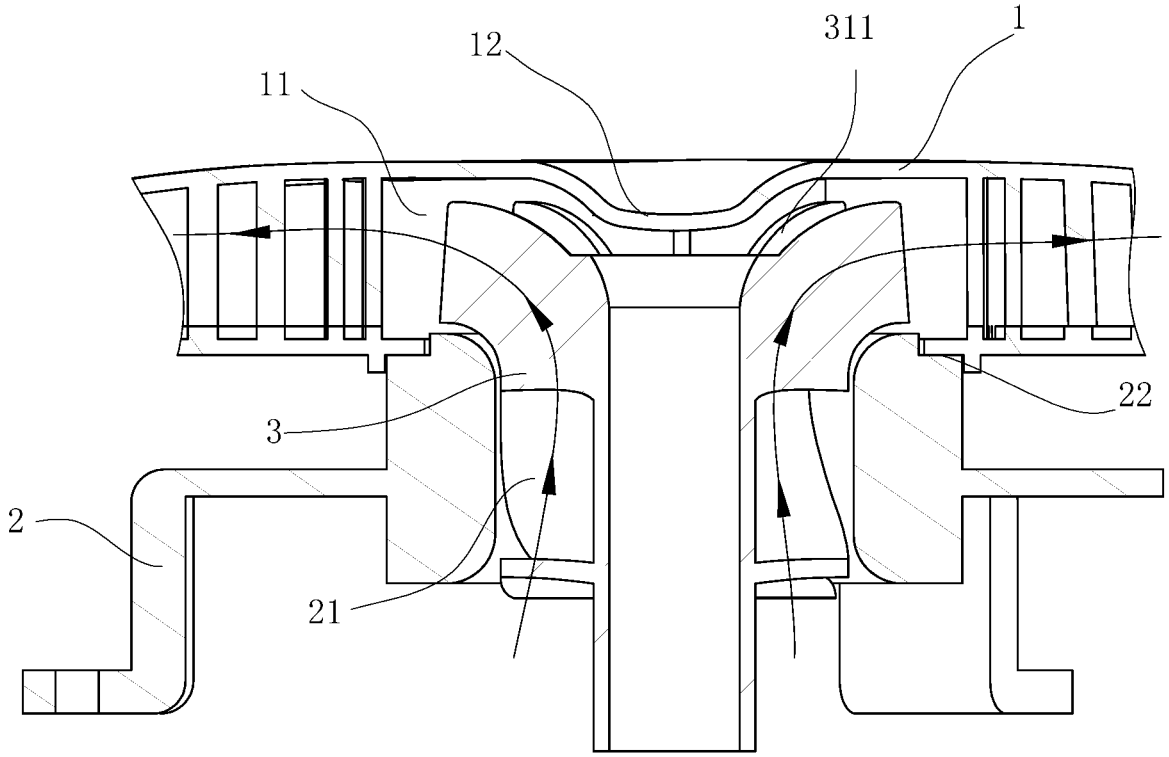
FIG. 1 is a sectional view of an open water pump according to Embodiment 1 of the present invention.
Figure 2:
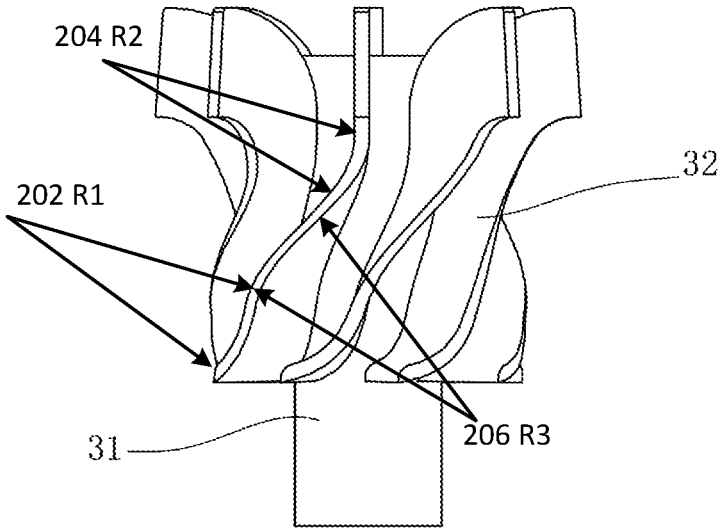
FIG. 2 is a front view of an impeller according to Embodiment 1 of the present invention.
Figure 3:
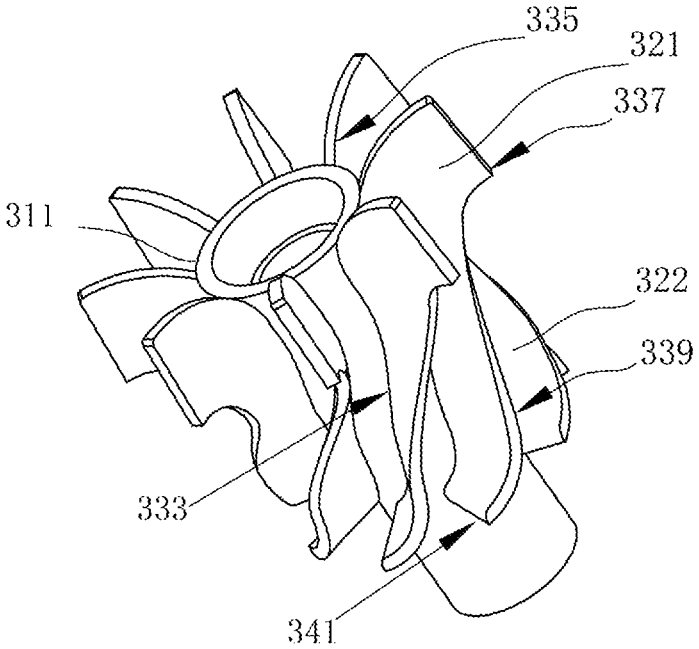
FIG. 3 is a perspective view of the impeller according to Embodiment 1 of the present invention.

FIG. 1-FIG. 3 show a preferred embodiment of an open water pump of the present invention. The open water pump comprises an upper casing 1 and a lower casing 2, which are contacted with each other to form a chamber for placing an impeller 3. An upper casing 1 has an upper chamber 11 for accommodating the upper portion of the impeller 3, a lower casing 2 has a lower chamber 21 for accommodating the lower portion of the impeller 3. No sealed connection is required between the upper casing 1 and the lower casing 2. For example, the outer periphery surface of the lower casing 2 can be formed with a step portion 22 on which a portion, around the upper chamber 11, of the upper casing 1 is rested. The space below the lower casing 2 is open, so that the water flow can enter the impeller 3 from the space below and a side of the lower casing 2. That is, water inlets of the water pump are located below and on a side of the lower casing 2, the top surface of the upper casing 1 corresponding to the upper chamber 11 is enclosed, and the water flow runs from the side of the upper chamber 11. That is, water outlets of the water pump are located within the upper casing 1 on a side of the upper casing 1. The water flow direction is indicated by an arrow in FIG. 1.

The impeller 3 has a central shaft 31 with a middle and a top and a plurality of blades 32 distributed uniformly on a periphery surface of the shaft 31, each blade extends from the top of the shaft 31 toward the middle of the shaft 31. A lower end of the shaft 31 is connected to an output shaft (not shown) of a motor used for driving the water pump, so that the impeller 3 can be driven to rotate when the motor rotates.

Each blade 32 has an upper portion 321 and a lower portion 322. The upper portion 321 and the lower portion 322 are integrated, the upper portion 321 is accommodated within the upper chamber 11 and the lower portion 322 is accommodated within the lower chamber 21, and a tail end of the lower portion 322 is preferably lower than a bottom surface of the lower chamber 21, that is, exposed downward from the lower chamber 21. Each blade 32 is defined by a base line 333 attached to the shaft 31, an upper arch 335 connected to the base line 333, an upper fringe 337 connected to the upper arch 335, a curving edge 339 connected to the upper fringe 337 and extending downwardly, and a lower edge 341 connected to the curving edge 339. The lower edge 341 is connected to the base line 333. The upper portion 321 is defined by the upper arch 335 and upper fringe 337 and the lower portion 322 is defined by the curving edge 339 and the lower edge 341. An edge line connects the upper fringe 337 to the lower edge 341 and the edge line is formed by three curved sections, 202, 204, 206. The section 204 has a concave curve with a radius R2, the section 206 has a convex curve with a radio R3, and the section 202 has a concave curve with a radius R1.

The upper portion 321 of the blade 32 is extended along a shaft plane of the shaft 31, and perpendicular to the outer periphery surface of the shaft 31. The lower portion 322 of the blade 32, at least at the bottom, which attached to the shaft 31 gradually bends along the rotation direction of the impeller 3, and a bent portion of the lower portion is distorted toward the rotation direction. With such an arrangement, when the blades 32 are rotating, the bottom thereof can lift water upward, so that water can move upward from the space below the impeller 3 from the pathway located between the blades 32. Even if the impeller 3 is not in an enclosed space, and with the absence of a vacuum, water can be drawn and delivered to the top from the bottom along with the rotation of the impeller 3.

In the present invention, a ratio of a height of the lower portion 322 of the blade 32 to a height of the upper portion 321 is preferably between 1 and 5, most preferably 3.

The lower portion 322 of the blade 32 is longer than the upper portion 322, and the portion for drawing water is thus longer, so that the blade 32 can be allowed to draw water at a low water level, it is less likely to get foam formed by washing liquid or food debris on the surface of water into the impeller 3 to influence the drawing of water, a sufficient amount of water can be drawn from the water inlets.

As described above, the lower portion 322 of the blade 32 is gradually bent at the bottom. It can be appreciated by those skilled in the art that this bending may occur at the whole lower portion 322, or the whole upper portion 321 and lower portion 322, i.e., the whole blade 32, as long as a gradually bent pathway is formed to lift the water flow upward from the bottommost end.

The upper portion of the blade 32 has a greater radial dimension, while the lower portion 322 has a smaller radial dimension. When the water flow runs upward from the bottom of the impeller 3, the pathway of water is gradually widened to reduce the flow rate. A ratio of a radial dimension of the upper portion 321 to a radial dimension of the lower portion 322 is preferably 1 to 5, most preferably 4/3.

The shaft 31 of the impeller 3 has an annular curved surface 311 extending outward from the top of the periphery surface. Thus, when the water flow moves toward the top from the bottom along with the rotation of the impeller 3, the flow rate is reduced, and furthermore, due to the annular curved surface 311, the flowing direction of the water flow can change to the transverse direction from the vertical direction at the top of the shaft 31, thus the annular curved surface 311 guides the water flow so that the water flow can also change the flowing direction without sealing the impeller 3 and get out from the upper chamber 11. Preferably, the top surface of the upper portion 321 of the blade 32 has an arc-shaped top surface with a same radius as the annular curved surface 311.

A space between the upper portion 321 of the blade 32 and the upper chamber 11 is greater than a space between the lower portion 322 and the lower chamber 21. That is, a diameter of the upper chamber 11 is greater than a diameter of the lower chamber 21. Thus, when the water flow runs from bottom up, the upper chamber 11 slows down the water flow, so that the velocity of the water flow when arriving at the top of the impeller 3 is reduced in order to avoid ejecting the upper casing 1 covered on the impeller 3.

Preferably, the shaft 31 is hollow, the upper casing 1 has a recess 12 with a same curvature as the annular curved surface 311 of the shaft 31 and disposed at a position corresponding to the top of the shaft 31, so that a vacuum area is formed between the top of the shaft 31 and the recess 12 of the upper casing 1 when the impeller 3 is rotating, in order to enable the top of the shaft 31 to exert a downward suction force onto the upper casing 1 to snap the upper casing 1. With such a structure, no additional fixing and connection structure is required between the upper casing 1 and the lower casing 2. What is only needed is to rest the upper casing 1 onto the lower casing 2. When the impeller 3 is rotating, the upper casing 1 will be snapped onto the lower casing 1, and the water flow runs out from a side of the upper chamber 11 within the upper casing 1 without ejecting the upper casing 1. Thus, the manufacturing and machining of water pumps are more convenient, and the assembly and disassembly of water pumps are easy. Alternatively, the upper casing 1 and the lower casing 2 can be connected to each other by a convenient and detachable connection mechanism, for example, a spinner, so that a water pump structure consisting of the upper casing 1, the lower casing 2 and the impeller 3 becomes more stable.

Embodiment 2

Figure 4:
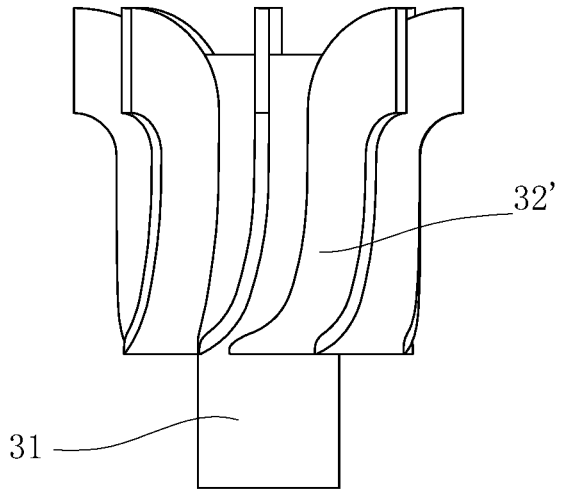
FIG. 4 is a front view of an impeller according to Embodiment 2 of the present invention.
Figure 5:
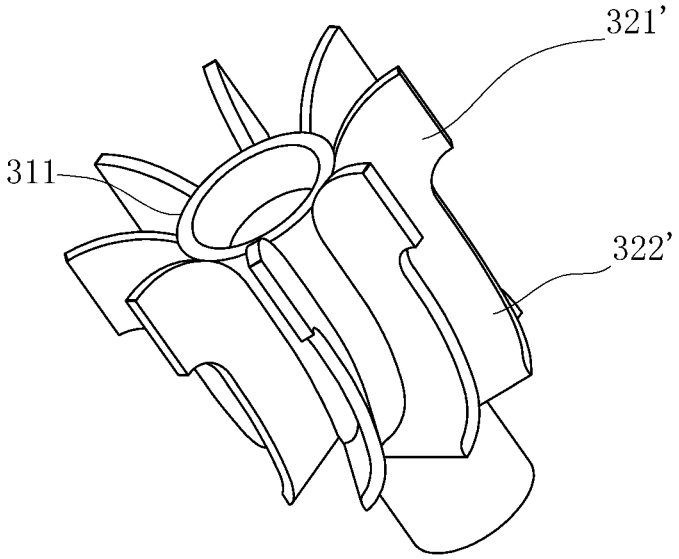
FIG. 5 is a perspective view of the impeller according to Embodiment 2 of the present invention.

FIG. 4 and FIG. 5 show a second embodiment of the present invention. The difference of this embodiment from Embodiment 1 is only the impeller. In detail, the lower portion 322' of the blade 32' is gradually bent along the rotation direction of the impeller, and the lower portion 322' and the upper portion 321' are both perpendicular to the periphery surface of the shaft 31.

Embodiment 3

Figure 6:
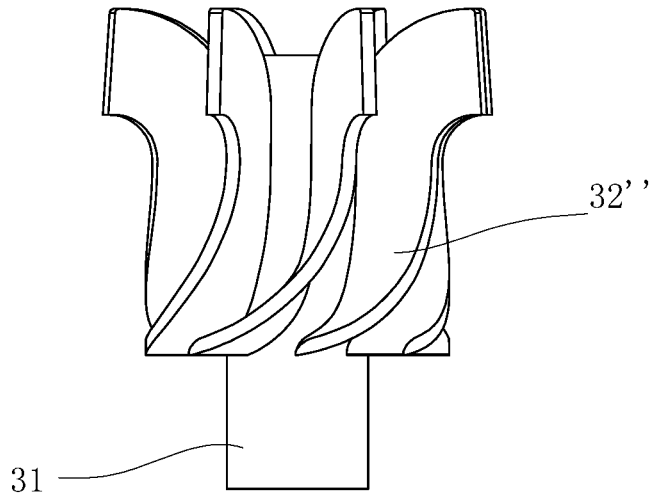
FIG. 6 is a front view of an impeller according to Embodiment 3 of the present invention.
Figure 7:
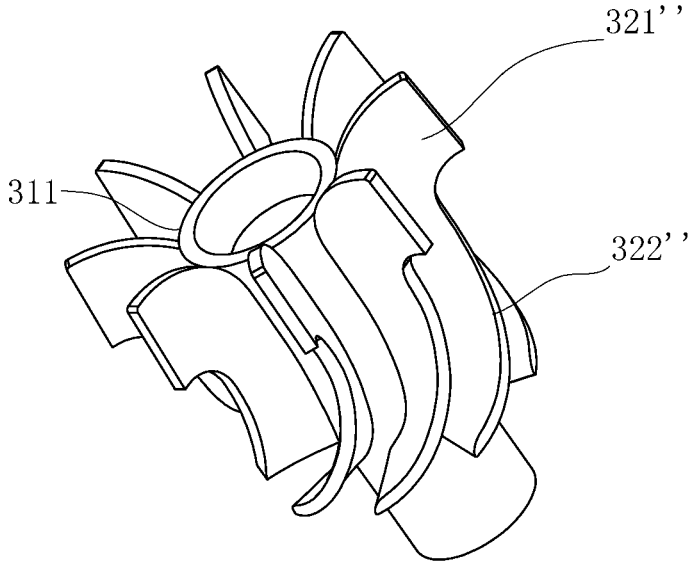
FIG. 7 is a perspective view of the impeller according to Embodiment 3 of the present invention.

FIG. 6 and FIG. 7 show a third embodiment of the present invention. The difference of this embodiment from Embodiment 1 is only the impeller. In detail, the lower portion 322" of the blade 32" is gradually bent along the rotation direction of the impeller, and inclined upward from the periphery surface of the shaft 31 away from the shaft 31, that is the outer side of each blade 3 which is away from the shaft 31 toward the rotation direction of the impeller 3. So that the upper portion 321" is perpendicular to the periphery surface of the shaft 31 and the lower portion 322" is inclined relative to the periphery surface of the shaft 31.

The invention claimed is:

1. An open water pump comprising:

an upper casing;

a lower casing attached to the upper casing forming a chamber, the lower casing is formed with a step portion on which the upper casing being rested;

an impeller disposed inside the chamber, the impeller having a central shaft with a middle and a top;

a plurality of blades distributed uniformly on a periphery surface of the shaft, each blade extends from the top of the shaft toward the middle of the shaft, each blade being defined by a base line attached to the shaft, an upper arch connected to the base line, an upper fringe connected to the upper arch, a curving edge connected to the upper fringe and extending downwardly, and a lower edge connected to the curving edge, the lower edge being connected to the base line, each blade having an upper portion and a lower portion, the upper portion defined by the upper arch and upper fringe and extending perpendicularly away from the shaft, the lower portion defined by the curving edge and the lower edge;

a plurality of inlets attached below and to a side of the lower casing; and a plurality of outlets attached to a side of the upper casing;

wherein, the upper casing has an upper chamber for accommodating the upper portion of each blade, the lower casing has a lower chamber for accommodating the lower portion of each blade, the upper portion extending perpendicularly away from the shaft, the lower portion of each blade bends along a rotation direction of the impeller, a ratio of a height of the lower portion of each blade to a height of the upper portion is 3, and an edge line connects the upper fringe to the lower edge and the edge line is formed by a first section with a concave curve, a second section with a convex curve, and a third section with a concave curve.

2. The pump of claim 1, wherein a ratio of a radial dimension of the upper portion of the blade to a radial dimension of the lower portion is between 1 and 5.

3. The pump of claim 2, wherein the ratio of the radial dimension of the upper portion to a radial dimension of the lower portion is 4/3.

4. The pump of claim 2, wherein a space between the side of the lower portion of the blade and the lower casing is smaller than a space between the side of the upper portion and the upper casing.

5. The pump of claim 1, wherein the upper portion of each blade extends perpendicularly outward from the periphery surface of the shaft, the lower portion of each blade is attached to the shaft and bends along the rotation direction of the impeller, and a bent portion of the lower portion is distorted toward the rotation direction.

6. The pump of claim 1, wherein the upper portion of each blade extends perpendicularly outward from the periphery surface of the shaft, the lower portion of each blade is attached to the shaft and bends in a curved shape along the rotation direction of the impeller.

7. The pump of claim 6, wherein the lower portion of each blade is inclined upwardly from the lower edge toward the upper portion.

8. The pump of claim 1, wherein the shaft has an annular curved surface extending outward from the top of the periphery surface.

9. The pump of claim 8, wherein the upper arch has a same radius as the annular curved surface.

10. The pump of claim 8, wherein the shaft is hollow, the upper casing has a recess with a same curvature as the annular curved surface of the shaft and disposed at a position corresponding to the top of the shaft.

11. The pump of claim 1, wherein the bottom of the lower portion of each blade extends out of the lower casing from the lower chamber.

* * * * *